US010952545B2

(12) United States Patent
Gervais

(10) Patent No.: US 10,952,545 B2
(45) Date of Patent: Mar. 23, 2021

(54) BABY AND INFANT EMERGENCY EVACUATION SYSTEMS AND METHODS

(71) Applicant: EVACUCHAIRS INC., Ottawa (CA)

(72) Inventor: Douglas Damasse Gervais, Ottawa (CA)

(73) Assignee: Evacuchairs Inc., Ottawa (CA)

( * ) Notice: Subject to any disclaimer, the term of this patent is extended or adjusted under 35 U.S.C. 154(b) by 19 days.

(21) Appl. No.: 16/373,946

(22) Filed: Apr. 3, 2019

(65) Prior Publication Data

US 2019/0307261 A1 Oct. 10, 2019

Related U.S. Application Data

(60) Provisional application No. 62/653,068, filed on Apr. 5, 2018.

(51) Int. Cl.

| | |
|---|---|
| ***A47D 13/02*** | (2006.01) |
| ***A61G 11/00*** | (2006.01) |
| ***A61G 5/06*** | (2006.01) |
| *A47D 13/08* | (2006.01) |
| *A62B 99/00* | (2009.01) |
| *A62B 1/02* | (2006.01) |

(52) U.S. Cl.

CPC ..... *A47D 13/02* (2013.01); *A61G 5/061* (2013.01); *A61G 5/066* (2013.01); *A61G 11/00* (2013.01); *A47D 13/08* (2013.01); *A61G 2200/14* (2013.01); *A62B 1/02* (2013.01); *A62B 99/00* (2013.01)

(58) Field of Classification Search

CPC ..... A47D 13/02; A47D 13/025; A61G 5/061; A61G 5/066; A61G 13/02; A62B 1/02

See application file for complete search history.

(56) References Cited

U.S. PATENT DOCUMENTS

| | | | | |
|---|---|---|---|---|
| 4,556,123 | A * | 12/1985 | Hargest, III | A62B 35/005 182/10 |
| 4,783,862 | A * | 11/1988 | Murphy | A47D 13/02 5/81.1 T |
| 6,783,135 | B1 * | 8/2004 | Nord | B60N 2/2806 280/30 |
| 7,125,022 | B2 * | 10/2006 | Medina | A61G 5/061 280/5.22 |
| 7,520,347 | B2 * | 4/2009 | Chambliss | A61G 5/061 180/8.2 |

(Continued)

*Primary Examiner* — Brian L Swenson

(74) *Attorney, Agent, or Firm* — Rosenberg, Klein & Lee

(57) ABSTRACT

Rapid evacuation of individuals from any building can be problematic. A hospital even more so as patient's often have the necessary motor skills but limited mobility. However, babies within neo-natal intensive care, infants and toddlers are particularly problematic as even under imminent danger they exhibit limited or no coordinated motor skills. In such situations an embodiment provides for evacuation devices for use by a single operator to move multiple infants or toddlers simultaneously both across a floor and down one or sets of stairs. Another embodiment provides for evacuation devices for moving intensive care neo-natal babies allowing the evacuation device to be moved by a single operator but allow another to be adjacent to the evacuation device to manually assist breathing both across the floor and within a stairwell as the evacuation device is taken down one or more sets of stairs.

13 Claims, 11 Drawing Sheets

(56) References Cited

U.S. PATENT DOCUMENTS

| | | | | |
|---|---|---|---|---|
| 8,307,473 | B1 * | 11/2012 | Lambarth | A61G 5/066 5/81.1 R |
| D781,187 | S * | 3/2017 | Calkin | D12/128 |
| 2009/0236380 | A1 * | 9/2009 | Adkins | A61G 1/04 224/161 |
| 2011/0115173 | A1 * | 5/2011 | Gervais | A61G 5/066 280/5.22 |
| 2016/0031470 | A1 * | 2/2016 | Poslowski | B62B 7/04 280/47.35 |
| 2018/0185212 | A1 * | 7/2018 | Lucas | A61G 5/061 |

* cited by examiner

PRIOR ART

BABY AND INFANT EMERGENCY EVACUATION SYSTEMS AND METHODS

CROSS-REFERENCE TO RELATED APPLICATIONS

This application claims the benefit of priority from U.S. Provisional Patent Application 62/653,068 filed Apr. 5, 2018 entitled "Baby and Infant Emergency Evacuation Systems and Methods", the entire contents of which is incorporated herein by reference.

FIELD OF THE INVENTION

This patent application relates to a transporter and more particularly to transports for moving neo-natal intensive care babies, infants, and toddlers from a region in danger to a safe area during an emergency or other event with reduced operator requirements.

BACKGROUND OF THE INVENTION

The rapid evacuation of individuals from any building can be problematic. Moving them out of a building with several floors compounds this as in the event of an emergency, such as fire, any elevators cannot be exploited, and individuals must use stairwells to go down one or more flights of stairs. Potentially, escalators are also disable returning them to providing a staircase.

With a hospital the issues are increased further as patient's often have the necessary motor skills but limited mobility. Further, babies within neo-natal intensive care, infants and toddlers are particularly problematic as even under imminent danger they exhibit limited or no coordinated motor skills. Accordingly, neo-natal and pediatric units within a hospital may in an emergency be faced with moving a significant number of babies, infants or toddlers within a limited number of nursing personnel, porters etc. Even with nurseries, childcare centers, etc. similar issues exist as generally the number of those being cared for is a multiple of the number of caregivers, where a limit on this ratio may be mandated by provincial, state, or federal law. Again, such enterprises may require evacuation down one or more flights of stairs.

In many instances the stairwell is a specific enclosed stairwell within the building lacking any combustible material and leading directly out of the building so as to protect those using the stairwell from fire within one or more areas adjacent to the stairwell.

Accordingly, it would be beneficial to provide hospitals, nurseries, daycares, etc. with an evacuation device for use by a single operator to move multiple infants or toddlers simultaneously both across a floor within the building to the stairwell and then down the one or more sets of stairs within the stairwell to the ground floor.

It would also be beneficial in other instances to provide for evacuation devices for moving intensive care neo-natal babies or other babies, toddlers, and infants who require assisted breathing such that in addition to the evacuation device being able to be moved by a single operator it allows for another operator to be adjacent to the evacuation device to manually assist breathing both across the floor and within a stairwell as the evacuation device is taken down one or more sets of stairs within the stairwell.

Other aspects and features of the present invention will become apparent to those ordinarily skilled in the art upon review of the following description of specific embodiments of the invention in conjunction with the accompanying figures.

SUMMARY OF THE INVENTION

It is an object of the present invention to mitigate limitations within the prior art relating to transporter and more particularly to transports for moving neo-natal intensive care babies, infants, and toddlers from a region in danger to a safe area during an emergency or other event with reduced operator requirements.

In accordance with an embodiment of the invention there is provided an evacuation device for a plurality of babies comprising:

a lower frame providing means for moving the evacuation device both across a horizontal floor and down a flight of stairs;

an upper frame connected to the lower frame comprising a first frame disposed on a first side of the evacuation device along a first predetermined portion of the length of the evacuation device and a second frame disposed on a second distal side of the evacuation device and along a second predetermined portion of the length of the evacuation device; and a plurality of cots disposed between the first frame and the second frame and pivotably mounted to each of the first frame and the second frame; wherein the plurality of cots maintain an approximately constant orientation relative to a horizontal plane upon motion of the evacuation device both across the horizontal floor and down the flight of stairs.

In accordance with an embodiment of the invention there is provided an evacuation device for a plurality of babies comprising:

a lower frame providing means for moving the evacuation device both across a horizontal floor and down a flight of stairs;

an upper frame connected to the lower frame comprising a first frame disposed towards a first side of the evacuation device along a first predetermined portion of the length of the evacuation device and a second frame disposed towards a second distal side of the evacuation device and along a second predetermined portion of the length of the evacuation device; and a plurality of seats disposed between the first frame and the second frame and pivotably mounted to each of the first frame and the second frame; wherein the plurality of seats maintain an approximately constant orientation relative to a horizontal plane upon motion of the evacuation device both across the horizontal floor and down the flight of stairs.

Other aspects and features of the present invention will become apparent to those ordinarily skilled in the art upon review of the following description of specific embodiments of the invention in conjunction with the accompanying figures.

BRIEF DESCRIPTION OF THE DRAWINGS

Embodiments of the present invention will now be described, by way of example only, with reference to the attached Figures, wherein.

DETAILED DESCRIPTION

Figure 1:
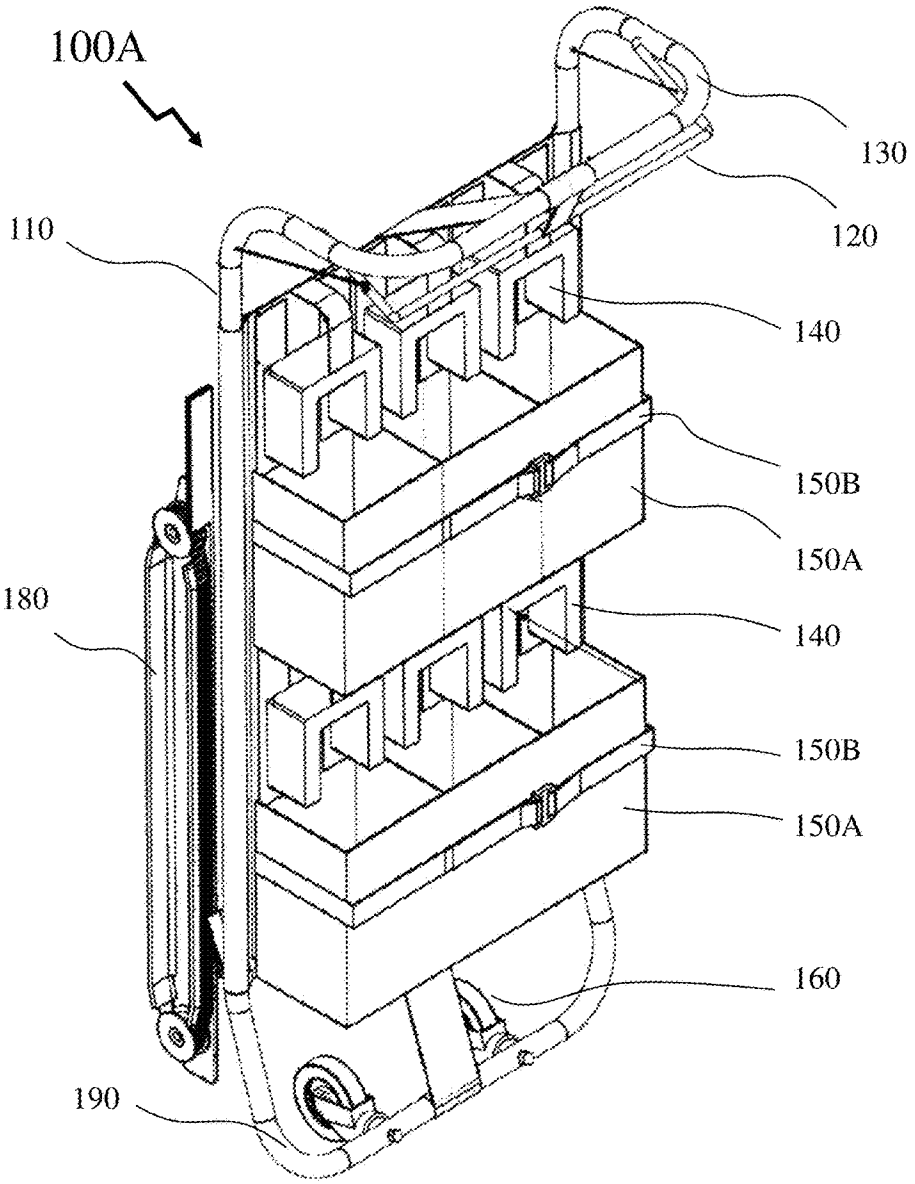
FIG. 1 depicts a prior art evacuation device for multiple babies.
Figure 1:
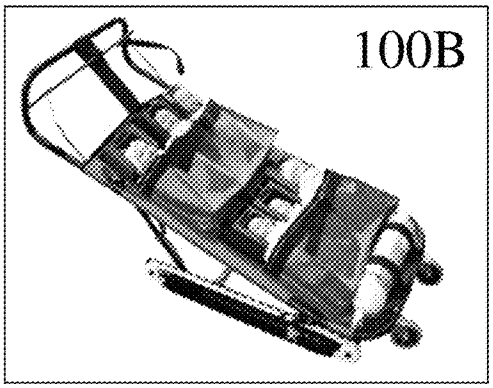

The present invention is direct to transporter and more particularly to transports for moving neo-natal intensive care babies, infants, and toddlers from a region in danger to a safe area during an emergency or other event with reduced operator requirements.

The ensuing description provides representative embodiment(s) only, and is not intended to limit the scope, applicability or configuration of the disclosure. Rather, the ensuing description of the embodiment(s) will provide those skilled in the art with an enabling description for implementing an embodiment or embodiments of the invention. It being understood that various changes can be made in the function and arrangement of elements without departing from the spirit and scope as set forth in the appended claims. Accordingly, an embodiment is an example or implementation of the inventions and not the sole implementation. Various appearances of "one embodiment," "an embodiment" or "some embodiments" do not necessarily all refer to the same embodiments. Although various features of the invention may be described in the context of a single embodiment, the features may also be provided separately or in any suitable combination. Conversely, although the invention may be described herein in the context of separate embodiments for clarity, the invention can also be implemented in a single embodiment or any combination of embodiments.

Reference in the specification to "one embodiment", "an embodiment", "some embodiments" or "other embodiments" means that a particular feature, structure, or characteristic described in connection with the embodiments is included in at least one embodiment, but not necessarily all embodiments, of the inventions. The phraseology and terminology employed herein is not to be construed as limiting but is for descriptive purpose only. It is to be understood that where the claims or specification refer to "a" or "an" element, such reference is not to be construed as there being only one of that element. It is to be understood that where the specification states that a component feature, structure, or characteristic "may", "might", "can" or "could" be included, that particular component, feature, structure, or characteristic is not required to be included.

Reference to terms such as "left", "right", "top", "bottom", "front" and "back" are intended for use in respect to the orientation of the particular feature, structure, or element within the figures depicting embodiments of the invention. It would be evident that such directional terminology with respect to the actual use of a device has no specific meaning as the device can be employed in a multiplicity of orientations by the user or users.

Reference to terms "including", "comprising", "consisting" and grammatical variants thereof do not preclude the addition of one or more components, features, steps, integers or groups thereof and that the terms are not to be construed as specifying components, features, steps or integers. Likewise, the phrase "consisting essentially of", and grammatical variants thereof, when used herein is not to be construed as excluding additional components, steps, features integers or groups thereof but rather that the additional features, integers, steps, components or groups thereof do not materially alter the basic and novel characteristics of the claimed composition, device or method. If the specification or claims refer to "an additional" element, that does not preclude there being more than one of the additional element.

Reference to a "bag valve mask" (BVM) as used herein and throughout this disclosure may refer to, but is not limited to, a manual resuscitator or "self-inflating bag." A BVM typically being a hand-held device commonly used to provide positive pressure ventilation to patients who are not breathing or not breathing adequately. Two principal types of manual resuscitators exist, self-inflating bags and flow inflating bags.

Reference to a "self-inflating manual resuscitator" or "self-inflating bag valve mask" ("self-inflating BVM") as used herein and throughout this disclosure may refer to, but is not limited to, a BVM where the material used for the bag-portion of the self-inflating a self-inflating manual resuscitator has a "memory", meaning after it is manually compressed it will automatically re-expand on its own in between breaths (drawing in air for the next breath). These devices can be used alone (thus delivering room-air) or can be used in connection with an oxygen source to deliver nearly 100% oxygen.

Reference to a "flow inflating manual resuscitator" or flow-inflating bag valve mask" (flow inflating BVM) as used herein and throughout this disclosure may refer to, but is not limited to, a BVM having a bag-portion that is flaccid and does not re-inflate on its own. This necessitates an external flow source of pressurized inflation gas for the bag to inflate;

once inflated the provider can manually squeeze the bag or, if the patient is breathing on his/her own, the patient can inhale directly through the bag itself.

Reference to a "caster" as used herein and throughout this disclosure may refer to, but is not limited to, a wheeled device typically mounted to a larger object that enables relatively easy rolling movement of the object across the ground. Casters are essentially special housings that include a wheel, facilitating the installation of wheels on objects. Such casters may include swivel casters which allow for movement in multiple directions (by swiveling relative to the object they are attached to) and rigid casters which restrict motion to forwards and backwards along a direction (defined by the wheels orientation relative to the object they are attached to).

Reference to a "continuous track" (commonly referred to as a track) also known as a "tank tread" or "caterpillar track" as used herein and throughout this disclosure may refer to, but is not limited to, a single flexible band or band of rigid treads or plates forming a closed-loop chain joined by flexible couplings driven by two or more driving wheels.

Reference to a "fitting" as used herein and throughout this disclosure may refer to, but is not limited to, any machine component, piping or tubing part that can attach or connect two or more parts. Such fittings may include, but not be limited to, a coupling, couplings, compression fitting, pipe fitting, piping fittings, plumbing fittings, and plumbing fitting.

Reference to a "mounting" as used herein and throughout this disclosure may refer to, but is not limited to, a part of a device, system, ancillary, etc. which is configured to support and/or attach another device, system, ancillary, components etc. to said part of the device, system, ancillary, component etc. A mounting typically supports demountable attachment of the parts but may be employed in permanent attachment to define the location of the point of attachment or support demountable attachment prior to permanent attachment.

Reference to a "fitting", "fixing" or "attachment means" as used herein and throughout this disclosure may refer to, but is not limited to, a component, device, or means employed to permanently or demountably attach a device, system, ancillary, components etc. to part of another device, system, ancillary, component etc. This may include, but not be limited to, depending upon whether permanent or demountable and the material(s) being joined fasteners, glues, resins, epoxies, cementing, welding, soldering, brazing, pressure differentials, magnets, clamps, clips, ties, supports, physical retention elements such as clips and crimps, and physical retention methods such as friction and interference fit. Fasteners may include, but not be limited to, bolts, nuts, washers, screws, threaded fasteners, rivets, nails, pins, hook-and-eye, and hook and loop.

Reference to a "demountable fitting" as used herein and throughout this disclosure may refer to, but is not limited to, a component, device, or means employed to demountably attach a device, system, ancillary, components etc. to part of another device, system, ancillary, component etc. and is a subset of fittings, fixings, and attachment means where the demountable fitting allows for a mechanical connection or joint to be made and unmade, generally multiple times. Examples may include, but not be limited to, a snap fastener, press stud, and ball-and-socket fasteners, and hook-and-eye.

Reference to a "demountable connection" as used herein and throughout this disclosure may refer to, but is not limited to, a component, device, or means employed to permanently or demountably attach an electrical connection or fluidic connection on a device, system, ancillary, components etc. to another electrical connection or fluidic connection on another device, system, ancillary, component etc. Electrical demountable connections are typically formed by plug and socket arrangements in discrete, linear array, or two-dimensional (2D) array formats or discrete male-female threaded connectors typically employed for microwave and RF. Fluidic demountable connections typically are formed by male-female threaded connectors with O-ring, sealing ring or gasket seals.

Reference to a "user" or "operator" as used herein and throughout this disclosure may refer to, but is not limited to, an individual or group of individuals. This includes, but is not limited to, private individuals, employees of organizations and/or enterprises, members of community organizations, members of charity organizations, professional individuals, men and women. In its broadest sense the user may further include, but not be limited to, mechanical systems, robotic systems, android systems, etc. that may be characterised by an ability to exploit one or more embodiments of the invention.

Reference to a "stairway", "staircase", "stairwell", "flight of stairs", or simply stairs as used herein and throughout this disclosure may refer to, but is not limited to, a construction designed to bridge a large vertical distance by dividing it into smaller vertical distances, called steps. Stairs may be straight, round, or may consist of two or more straight pieces connected at angles. Each step comprises a tread (the part of the stairway that is stepped upon), a riser (the vertical portion between each tread on the stair, which may be missing for an "open" stair effect), and a nosing (the edge part of the tread protrudes over the riser beneath).

Reference to a "banister", "railing" or "handrail" as used herein and throughout this disclosure may refer to, but is not limited to, an angled member down a staircase for handholding, as distinguished from the vertical balusters which hold it up for stairs that are open on one side. There may be a railing on both sides, sometimes only on one side or not at all, on wide staircases there is sometimes also one in the middle, or even more. The term "banister" is sometimes used to mean just the handrail, or sometimes the handrail and the balusters or sometimes just the balusters.

Reference to a "brace" as used herein and throughout this disclosure may refer to, but is not limited to, a rigid element intended to join two or more elements together and maintain the two or more elements in fixed relative positions to each other.

Reference to a "nosing" as used herein and throughout this disclosure may refer to, but is not limited to, the horizontal, protruding edge of a stair or step where most foot traffic frequently occurs.

Referring to FIG. 1 there is depicted depicts a prior art evacuation device for multiple babies in a collapsed or storage state. The main tubular frame 110 forms the main support system for the baby carrier elements and the wheel-track assembly that allows movement of the baby evacuation device (BED) 100A across a floor and stairs.

The tubular frame 110 is one solid entity that requires no assembly. Attached to the bottom of the frame as the BED 100A is employed are a pair of tracks 180 allowing the BED 100A to traverse across the floor and then be employed by the operator to descend one or more flights of stairs. The handle 130 at one end of the frame 110 allows for the operator to walk with the BED 100A at arm's length and descend the stairs safely, allowing to clearly view steps as they descend. The reverse brake handle 120 is engaged by default and is disengaged when the operator squeezes the brake handle 120 to the main frame. Accordingly, if the operator releases the brake handle 120 the brake under pressure makes contact with the tracks 180 and stops the descent of the device. The other end of the frame 180 from the handle 130, identified as frame portion 190, is angled at a predetermined angle away from the plane of the BED 100A ensuring that the casters 160 are positioned at the correct angle such that upon reaching the bottom of the flight of stairs to a landing or floor that the BED 100A can be continuously moved to facilitate the quick and smooth movement of the BED 100A from the flight of stairs to horizontal surface without additional intervention.

As depicted the BED 100A provides carrying six infants in a series of pouches. Each pouch has associated with it an adjustable U-shaped head rest 140 with a loop and hook system stitched to the bottom. A pair of loop and hook system straps are attached to the main body of a support membrane (not depicted for clarity) attached across the frame. Due to the attachment means of the U-shaped head rest 140 the operator can quickly tear away the headrest, slide the infant into a pocket, re-position the headrest around the infant's head and secure the headrest to the loop & hook system. Further, the adjustable nature of the head rest 140 attachment allows the operator to make adjustments to accommodate for any size of infant head. The two large pockets 150A (one per row) are attached to the support membrane wherein interior pocket walls divide the two larger pockets 150A into 6 individual sub-pockets. These sub-pockets are designed in such a way to provide the operator with the ability to tear away the interior wall or walls to accommodate for larger babies or an increased number of babies in the case of extreme over-crowding or limited operators to evacuate the number of babies at the hospital, ward, daycare, nursery etc. Once the babies are placed inside the sub-pockets, a belt 150B is drawn snug across each large pocket 150A where the belt may be secured to the frame by a loop & hook system. The support membrane allows for movement of the frame 110 relative to the babies within the large pockets 150A and provides some cushioning, by virtue of being flexible as the support membrane is not taut, as the BED 100A is moved. The BED 100A is depicted in deployed state 100B wherein the frame 110 is now tilted relative to the tracks 180 bringing the handle 130 to a height the operator can employ during use.

Evacuation Device Elements

Figure 4:
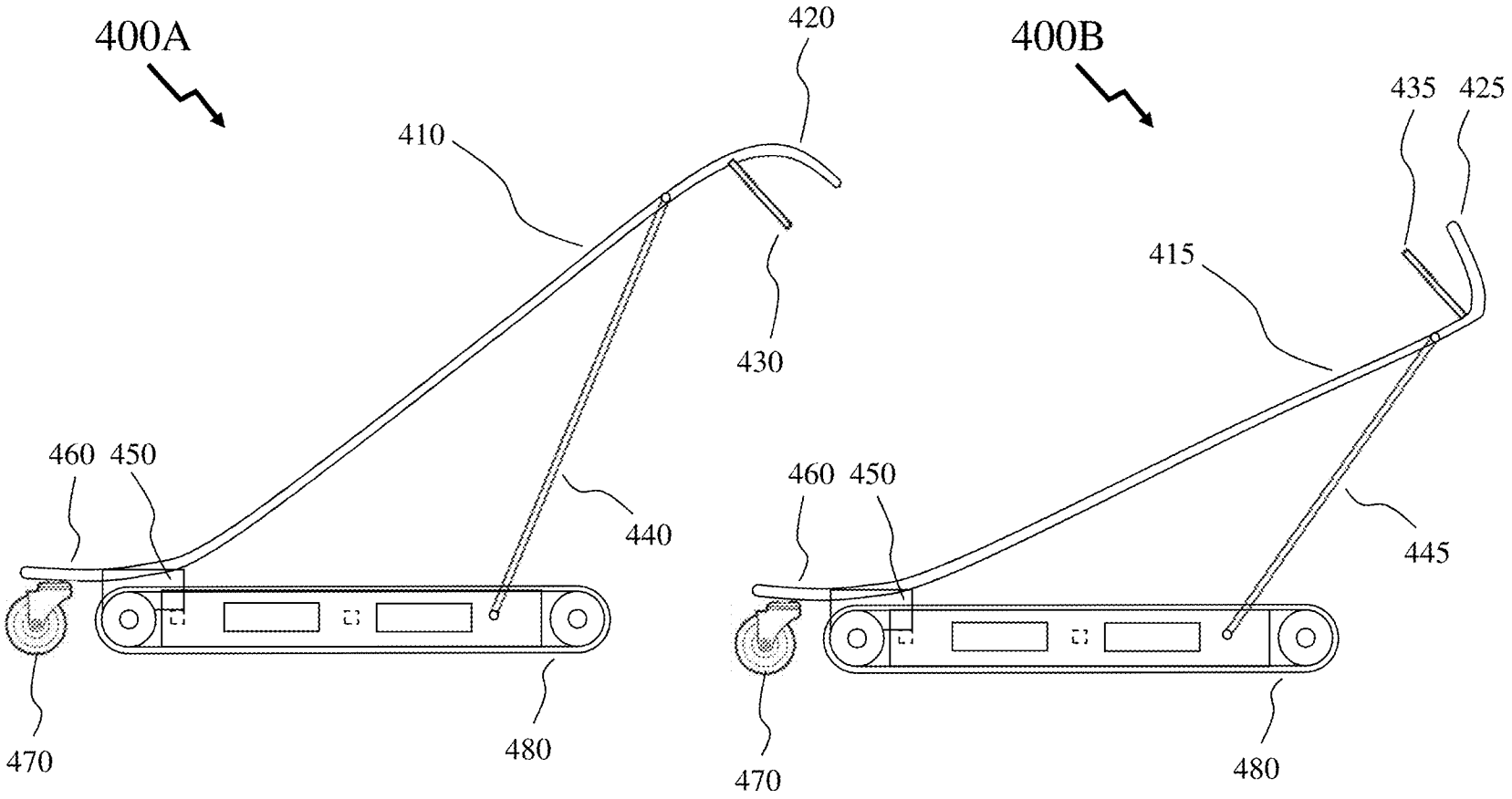
FIG. 4 depicts simplified schematics of frame assemblies for evacuation devices according to an embodiment of the invention.

In contrast the respirator evacuation device (R-EVAC) for babies and/or infants requiring respirator assistance or other attention and the infant evacuation device (I-EVAC) for infants and/or toddlers according to embodiments of the invention exploit different physical configurations as depicted in FIG. 4. As depicted the R-EVAC according to an embodiment of the invention is designed to evacuate three babies and/or infants whereas the I-EVAC according to an embodiment of the invention is designed to evacuate four infants and/or toddlers in the event of an emergency, e.g. fire, earth quake etc.

Figure 2:
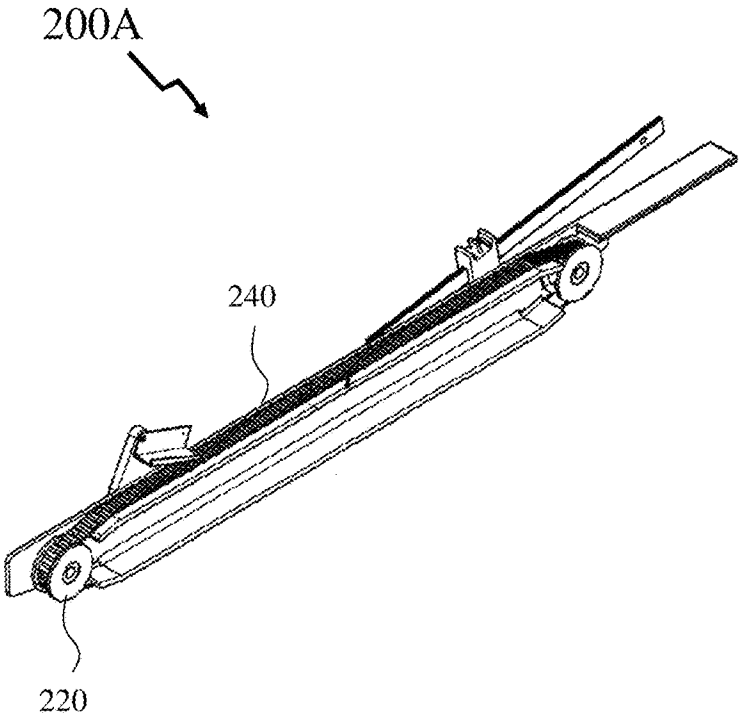
FIG. 2 depicts a tread for evacuation devices according to embodiments of the invention.

In each instance a collapsible rail assembly, also connected to the main frame, is comprised of two laterally spaced tracks with sliding endless belts, used to support the device as it glides down the stairs. Further, in each instance there is a reverse braking device on the track system to assist the operator in a stairwell descent permitting the operator to release the brake handle on the device thereby permitting the device to stop on the descent down the flight of stairs and remove any debris etc. that may be in the path of evacuation. Referring to FIG. 2 there is depicted an example of a track assembly forming part of an I-EVAC and/or R-EVAC according to embodiments of the invention. The devices comprise a frame and connectors to which the pair of laterally spaced tracks 200A are attached, each comprising a sliding endless grooved belt 240 around a pair of pulleys 220. Accordingly, in descent, as depicted in FIG. 3, each track 200A bridges the gaps between two or more nosings of the steps within the flight of stairs such that the device can move down the flight of stairs in a continuous manner. The grooves on the exterior surface of the grooved belts 240 are of a geometry such that when the brake of the device is released one or more nosings of the stairs are within one or more grooves allowing the device to stay in position without operator assistance. The grooved belts 240 also being composed of a material or having materials disposed on the groove surfaces to support frictional engagement with the nosings and steps. For example, the grooved belt 240 may be formed from a natural rubber, artificial rubber or other similar material.

Attached to the front of the main frame of the I-EVAC and/or R-EVAC are one of more casters to help the operator manipulate the device quickly and efficiently over a horizontal plane as the I-EVAC and/or R-EVAC is either moved across a floor or as the I-EVAC and/or R-EVAC reaches the bottom of a flight of stairs and the front of I-EVAC and/or R-EVAC reaches either the horizontal landing between pairs of flights of stairs or the floor from which evacuation out of the building will be made. This horizontal area may be quite small such as the restricted area of a stairwell landing. The main frame may comprise a U-shaped tubular section at the front with the caster attached in the middle with one or more lateral elements to which the upper frame of the I-EVAC and/or R-EVAC is attached. The main frame may extend further back to provide multiple attachment points for the tracks 200A as well as additional bracing elements between the tracks 200A to maintain their positions. Optionally, the tracks 200A may be directly joined together by braces and then the front section of the main frame attached to those braces at the front.

Within embodiments of the invention some devices may exhibit a unique design feature at the bottom to accommodate the castors. The casters only engage the horizontal plane when the device is lifted by the operator. The top of the frame also has a unique design permitting the operator to see through an empty space between the bar grip and the top of the patient support membrane as he/she descends the stairs, to ensure that no unseen obstruction will cause the operator to stumble. The babies are placed into each pocket so that their heads are secured with the unique, adjustable U-shaped cushioned head rests and are secured for transport. With the chair's ability to turn 360 degrees to manipulate crowded halls and stairwell landings, the headrest adds sufficient safety for the infants. Once removed from the wall bracket and placed on the floor, the operator grips the top handle of the main frame while the lower end with the casters rests on the floor. The operator then lifts the chair up to their waist and with a sharp jerk down, deploys the rail system with the aid of gravity. The device is now ready to have infants placed inside.

The frame provides the option for two operators to carry either the I-EVAC and/or R-EVAC devices upstairs or over an obstacle etc., if required. Further, ropes can be attached to either of the I-EVAC and/or R-EVAC frames in order to lower the device from a window should other exits be blocked or unsafe. Once outside the building the device can be wheeled to a safe area or loaded into a vehicle intact, for transport. The babies, infants or toddlers are safe and can be monitored at all times while remaining in the device until permission is granted to re-enter the building or until they are moved to another premise.

Figure 3A:
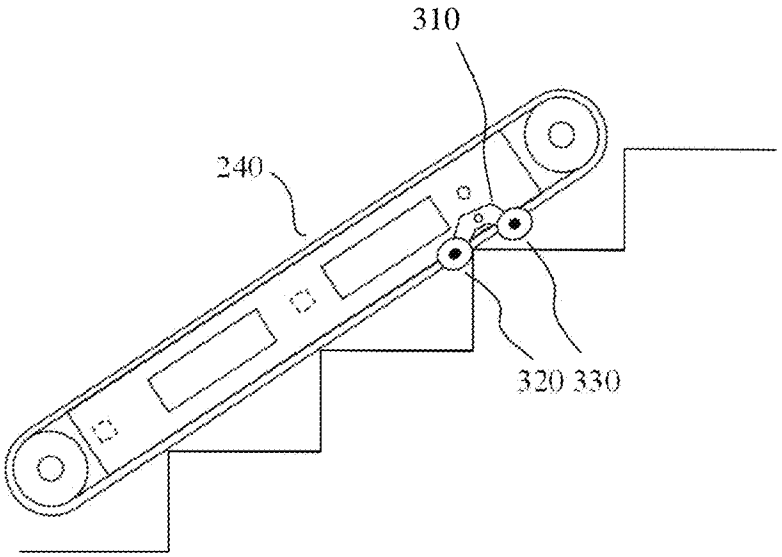
FIGS. 3A and 3B depict a tread and wheel assembly for evacuation devices according to embodiments of the invention.
Figure 3B:
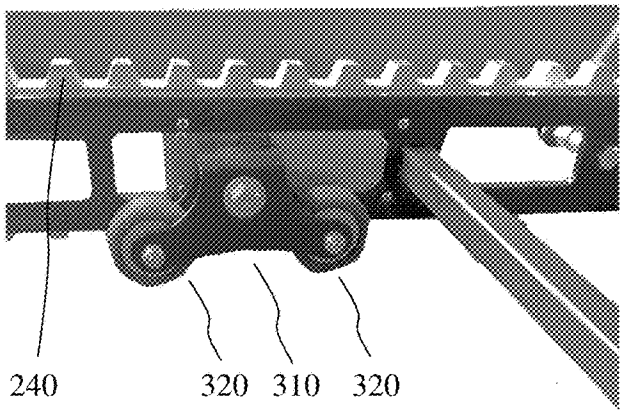

Now referring to FIGS. 3A and 3B respectively there is depicted a schematic of a track 240 and its associated frame together with a wheel structure 310 comprising first and second wheels 320 and 330 respectively which are disposed on the inner side of each track assembly provided on opposite sides of the main body frame structure. As depicted these wheel structures 310 are disposed towards the rear ends of the crawler devices. Each wheel structure 310 has the pair of ground contacting wheels 320 and 330 rotatably connected to the frame such that they project down beyond the tracks 240 and contact a horizontal ground surface reducing the area of the tracks 240 in contact with the ground surface for reduced resistance to moving the I-EVAC and/or R-EVAC devices along the horizontal surface. As each wheel structure 310 is pivotably attached to the frame then if travelling on a horizontal surface if either of one of the wheels 320 and 330 is bumped by a force from below, the bumped wheel will move upwardly whereas the other wheel will move downwardly so that wheels are in contact with the ground. However, when going down a flight of stairs this relationship does not exist and according the wheel structure 310 pivots further allowing the tracks 240 to engage the nosings of the stairs and the I-EVAC and/or R-EVAC devices to move down the stairs and the wheel structures 310 merely jump the nosings, treads etc. An assembled track 240 with frame and wheel structure 310 comprising first and second wheels 320 and 330 respectively being depicted in FIG. 3B.

Now referring to FIG. 4 there is depicted a first outline simplified sketch 400A of the upper frame and main frame for the I-EVAC device. As depicted the main frame 450 is connected to the track assembly 480 and includes a front section 460 to which the caster 470 is attached. The caster 470 projecting slightly below the level of the track assembly 480 so that the caster 470 supports the front of the I-EVAC when on a horizontal surface. The upper frame 410 portion of the I-EVAC is coupled to the main frame 450 and ends at the handle 420. Also attached to the handle 420 and upper frame 410 is brake handle 430. The upper frame 410 is also connected to the rear portion of the track assemblies 480 or the main frame 450, if this projects far enough back, by strut 440. As will be subsequently described and depicted in respect of FIGS. 12 and 13 below the upper frame 410 supports the plurality of cots which support the babies during their transport by the I-EVAC. The struts 440 are within some embodiments of the invention fixed but within others they are telescopic allowing the I-EVAC to be stored in a collapsed state. Beneficially, the operator can simply lift the handle 420 and with a lifting or lifting and jerk motion the bottom portion of the I-EVAC drops down, the telescopic struts 440 extend and lock into the open position such that the operator does not spend time trying to transition the I-EVAC from a stored condition to one ready to use and can do so with a single hand.

Also referring to FIG. 4 there is depicted a second outline simplified sketch 400B of the upper frame and main frame for the R-EVAC device. As depicted the main frame 450 is connected to the track assembly 480 and includes a front section 460 to which the caster 470 is attached. The caster 470 projecting slightly below the level of the track assembly 480 so that the caster 470 supports the front of the R-EVAC when on a horizontal surface. The upper frame 415 portion of the R-EVAC is coupled to the main frame 450 and ends at the handle 425. Also attached to the handle 425 and upper frame 415 is brake handle 435. The upper frame 415 is also connected to the rear portion of the track assemblies 480 or the main frame 450, if this projects far enough back, by strut 445. As will be subsequently described and depicted in respect of FIGS. 12 and 13 below the upper frame 415 supports the plurality of seats which support the infants and/or toddlers during their transport by the R-EVAC. The struts 445 are within some embodiments of the invention fixed but within others they are telescopic allowing the I-EVAC to be stored in a collapsed state. Beneficially, the operator can simply lift the handle 425 and with a lifting or lifting and jerk motion the bottom portion of the R-EVAC drops down, the telescopic struts 445 extend and lock into the open position such that the operator does not spend time trying to transition the R-EVAC from a stored condition to one ready to use and can do so with a single hand.

With each of the I-EVAC depicted in first simplified sketch 400A in FIG. 4 and the R-EVAC depicted in the second simplified sketch 400B the structs 440 and 445 respectively may be collapsible where the I-EVAC and/or R-EVAC are designed to be "collapsed" for reduced storage space. Optionally, they may be rigid and fixed struts such that the geometry of the I-EVAC and/or R-EVAC is fixed. Optionally, they may be composed of two or more sections exploiting spring loaded pins engaging holes in the structs so that they can be adjusted in length such that the height of handles etc. can be adjusted. In these instances, the upper arms would be joined to the main frame with pivotable connections.

Figure 5:
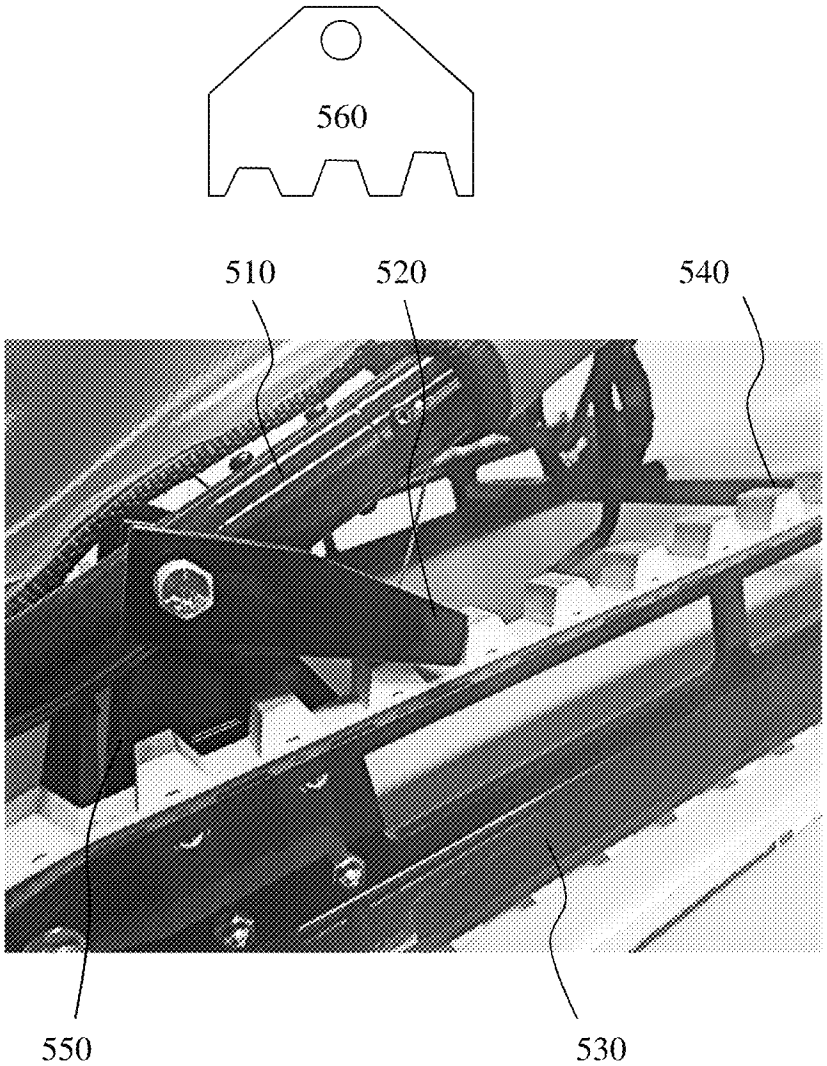
FIG. 5 depicts a braking assembly for an evacuation device according to an embodiment of the invention.

Now referring to FIG. 5 there is depicted a schematic of the brake assembly for locking the grooved track 540 of the track assembly 530. Also depicted is part of a main frame 510. The brake arm 520 is pivotably coupled to a brake mounting 550 and is linked to the brake handle by one or more brake cables. Accordingly, pulling the brake handle pulls the one or more brake cables thereby lifting or pulling the brake arm 520 away from the grooved track 540 of the track assembly 530. Releasing the brake results in the one or more brake cables returning to their default position such that the brake arm 520 returns to its default position and engages with a groove within the grooved track 540. Accordingly, the brake assembly acts as a "dead man's handle" for the I-EVAC or R-EVAC and other embodiments of the invention in that the brake must be continuously engaged by the operator in order for the evacuation devices according to embodiments of the invention to move. If the operator releases the brake handle the evacuation device stops upon the stairs as the brake arm 520 engages the grooves within the grooved track 540 and these very same grooves engage the nosings of the stairs to halt the motion of the evacuation device. Optionally, the brake pad 560 may comprise multiple "teeth" for engaging the grooved track 540, these teeth may be the same depth, varying depths, etc.

Figure 6:
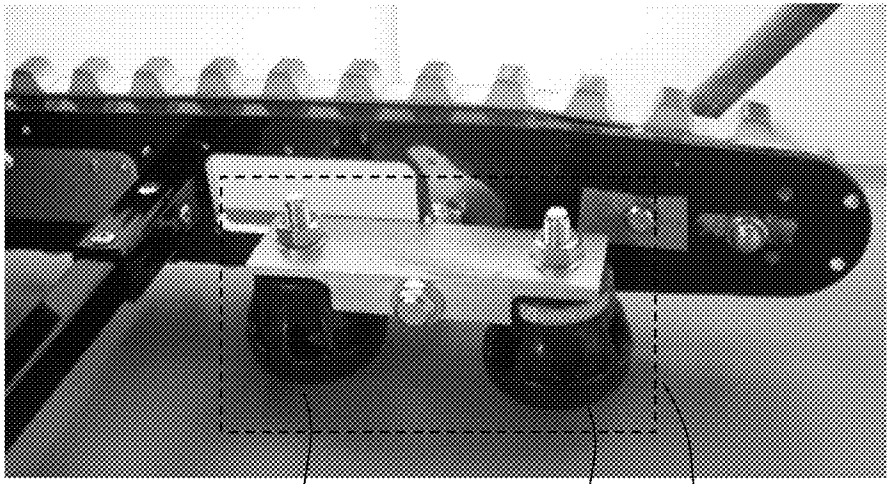
FIG. 6 depicts an omnidirectional caster assembly for the rear of an evacuation device according to an embodiment of the invention.

Referring to FIG. 6 there is depicted an alternate rear gliding assembly 610 comprising omnidirectional rollers 620 thereby supporting omnidirectional motion rather than the linear wheel structures 310 depicted in FIG. 3. Accordingly, the I-EVAC and/or R-EVAC exploiting these rear wheel assemblies 610 in conjunction with the one or more casters at the front of the I-EVAC and/or R-EVAC have increased maneuverability.

Figure 7:
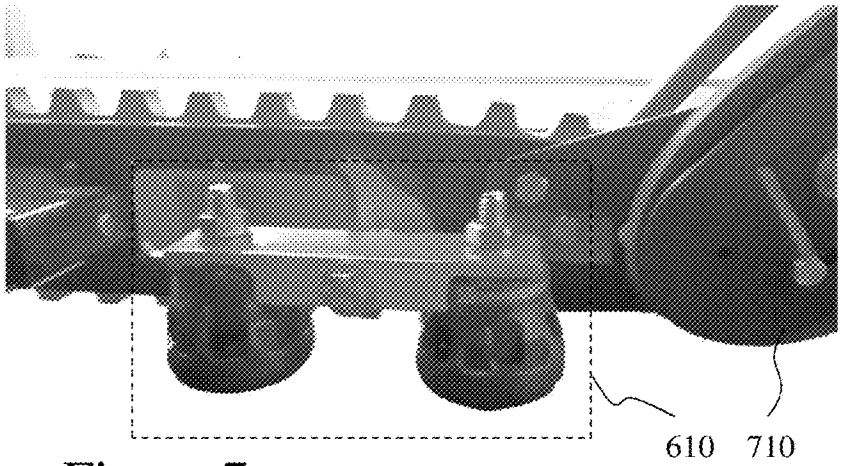
FIG. 7 depicts an omnidirectional caster assembly for the rear of an evacuation device in conjunction with an angled track assembly according to an embodiment of the invention.
Figure 8:
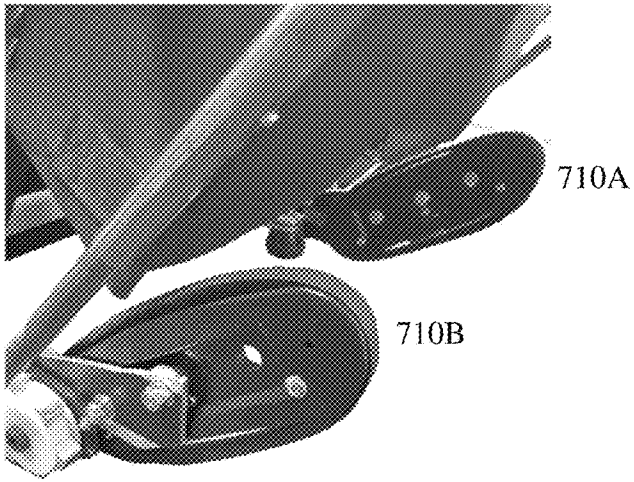
FIG. 8 depicts the rear of an evacuation device employing an angled track assembly according to an embodiment of the invention.
Figure 9:
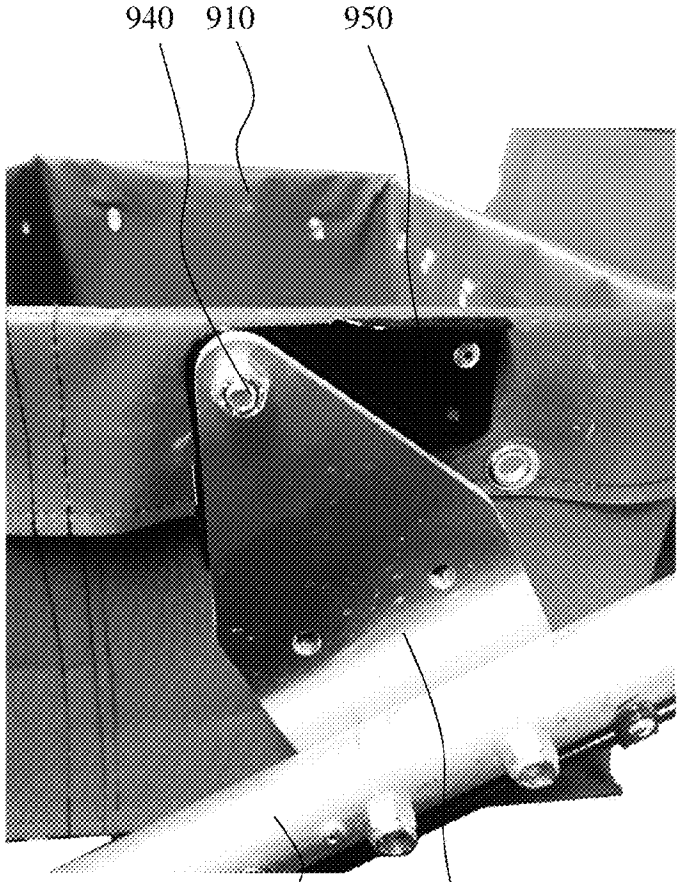
FIG. 9 depicts a bracket and carrier assembly according to an embodiment of the invention providing automatic levelling of the carrier as the evacuation device to which it is attached is moved into different positions.

Now referring to FIG. 7 there is depicted an alternate rear wheel and track assembly comprising a rear gliding assembly 610 such as depicted in FIG. 6 mounted to the track assembly such as track assembly 480 depicted in FIG. 4 or track 200A in FIG. 2. Also disposed at the rear of the I-EVAC and/or R-EVAC is a rear track assembly 710 which is designed to engage the steps/stairs as the I-EVAC and/or R-EVAC is transitioned from going down, for example, a set of steps and/or stairs to the landing or floor and its subsequent movement in a horizontal configuration. As the I-EVAC and/or R-EVAC reaches the bottom of a flight of stairs, for example, a wheel or wheels at the front, e.g. caster 470 in FIG. 4, allow the I-EVAC and/or R-EVAC to move forward on the horizontal or near horizontal landing between flights of stairs or a floor at the bottom of the stairs. As the I-EVAC and/or R-EVAC is pushed further forward the rear track assembly 710 takes over from the track assembly 480 as the rear of the I-EVAC and/or R-EVAC is the final portion of the I-EVAC and/or R-EVAC engaging the last few stairs in the flight of stairs. As evident from FIG. 8 a pair of rear track assemblies 710A and 710B respectively may be employed on each side of the I-EVAC and/or R-EVAC. As depicted each rear track assembly 710A and 710B respectively comprises a belt without large surface contours which rotates around a pair of wheels. The belt may be textured for enhanced traction/friction against Referring to FIG. 9 there is depicted a design for a pivot to mount a carrier 910 to the frame 920 of an I-EVAC and/or R-EVAC allowing the carrier 910 to pivot such that as the I-EVAC and/or R-EVAC is transitioned from horizontal to down a flight of stairs or vice-versa the carrier 910 remains substantially horizontal. Accordingly, a frame bracket 930 attached to the frame is connected to a carrier bracket 950 attached to the carrier via a mounting 940 which allows the carrier 910 to rotate relative to the frame 920. Optionally, the mounting 940 may dampen motion so that the carrier 910 does not move quickly become essentially a fast moving pendulum as the I-EVAC and/or R-EVAC moves from one position relative to the horizontal to another position relative to the horizontal. Further, the carrier bracket 950 may have a first stop and/or a second stop, the first stop to limit motion of the carrier 910 in a first direction, e.g. as the I-EVAC or R-EVAC is lifted, and the second stop to limit the motion of the carrier 910 in the other direction. Optionally, the first stop and/or a second stop may have an absorbent material, e.g. foam, disposed towards the frame bracket 930 in order to soften the impact of the moving carrier 910 with either the first stop and/or a second stop.

Figure 11:
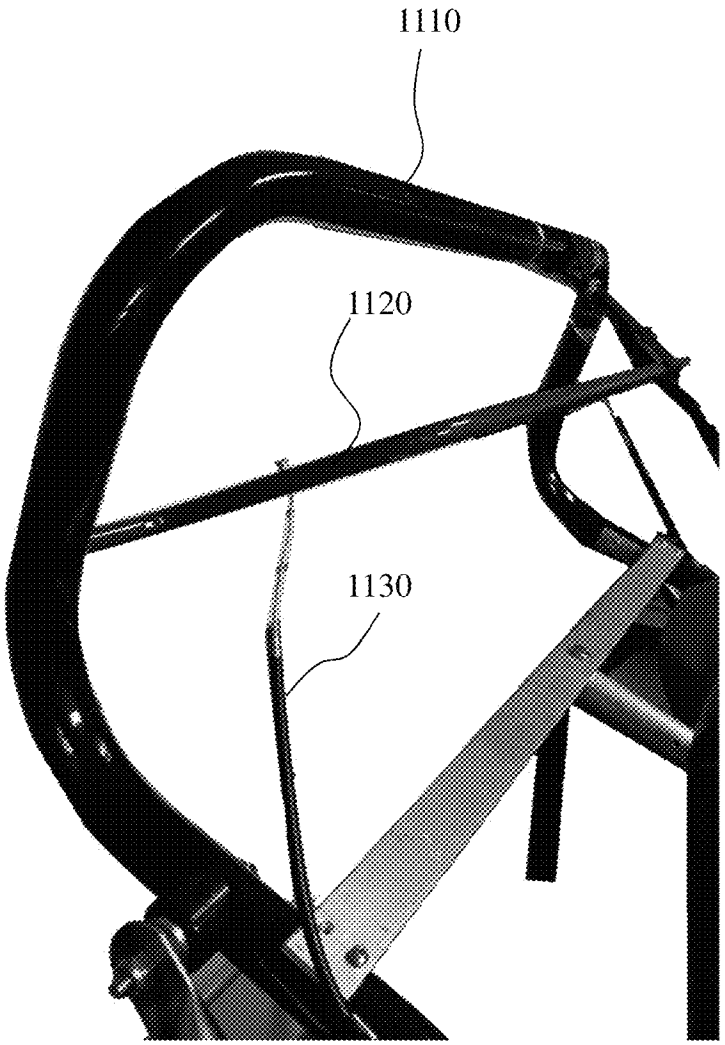
FIG. 11 depicts a handle and brake assembly for an evacuation device according to an embodiment of the invention.
Figure 10:
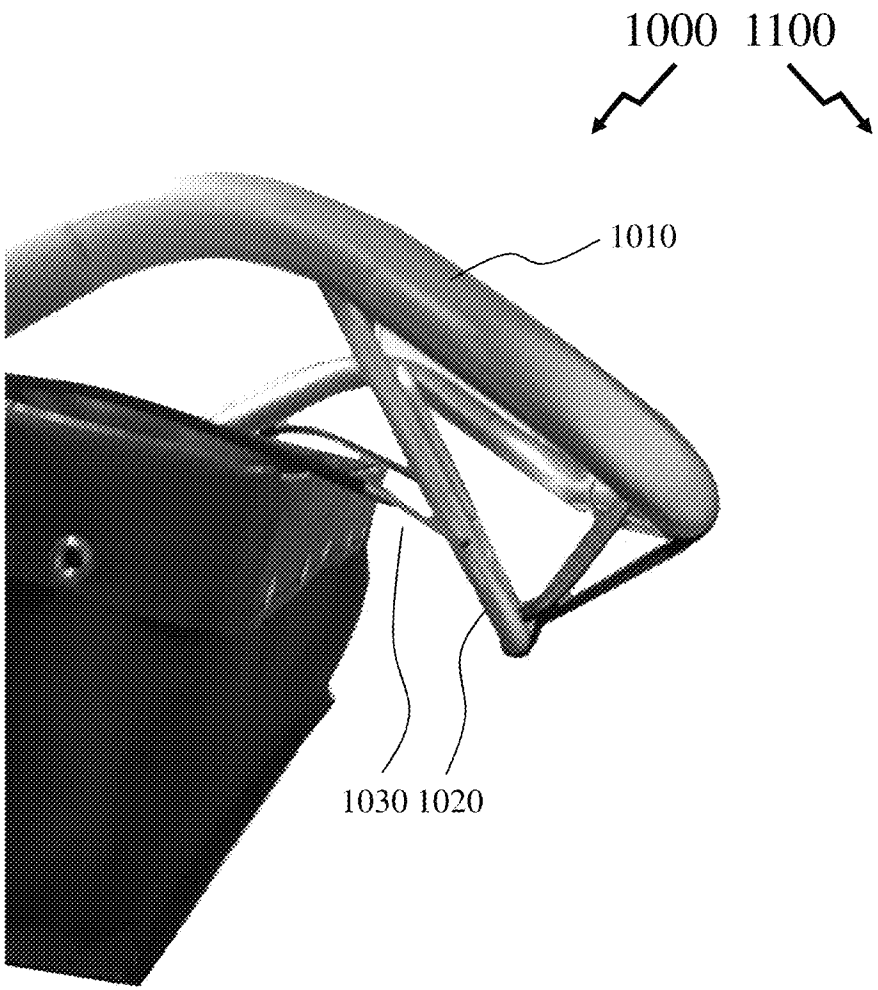
FIG. 10 depicts a handle and brake assembly for an evacuation device according to an embodiment of the invention.

Referring to FIGS. 10 and 11 there are depicted first and second handle assemblies 1000 and 1100 respectively. First handle assembly 1000 being used upon an R-EVAC for example whilst second handle assembly 1100 is employed upon an I-EVAC for example. Referring initially to FIG. 10 the first handle assembly comprises a handle 1010 and a brake handle 1020. The brake handle 1020 is connected to one or more brake cables 1030 to engage the brake or brakes upon the evacuation device according to an embodiment of the invention. The handle 1010 projects backwards and downwards, such as depicted with handle 1260 of the R-EVAC depicted in FIG. 12, such that the individual controlling the evacuation device according to an embodiment of the invention can push the handle 1010 when the evacuation device according to an embodiment of the invention is both on the horizontal or going down a flight of stairs wherein the handle is approximately horizontal in this latter scenario.

Figure 14:
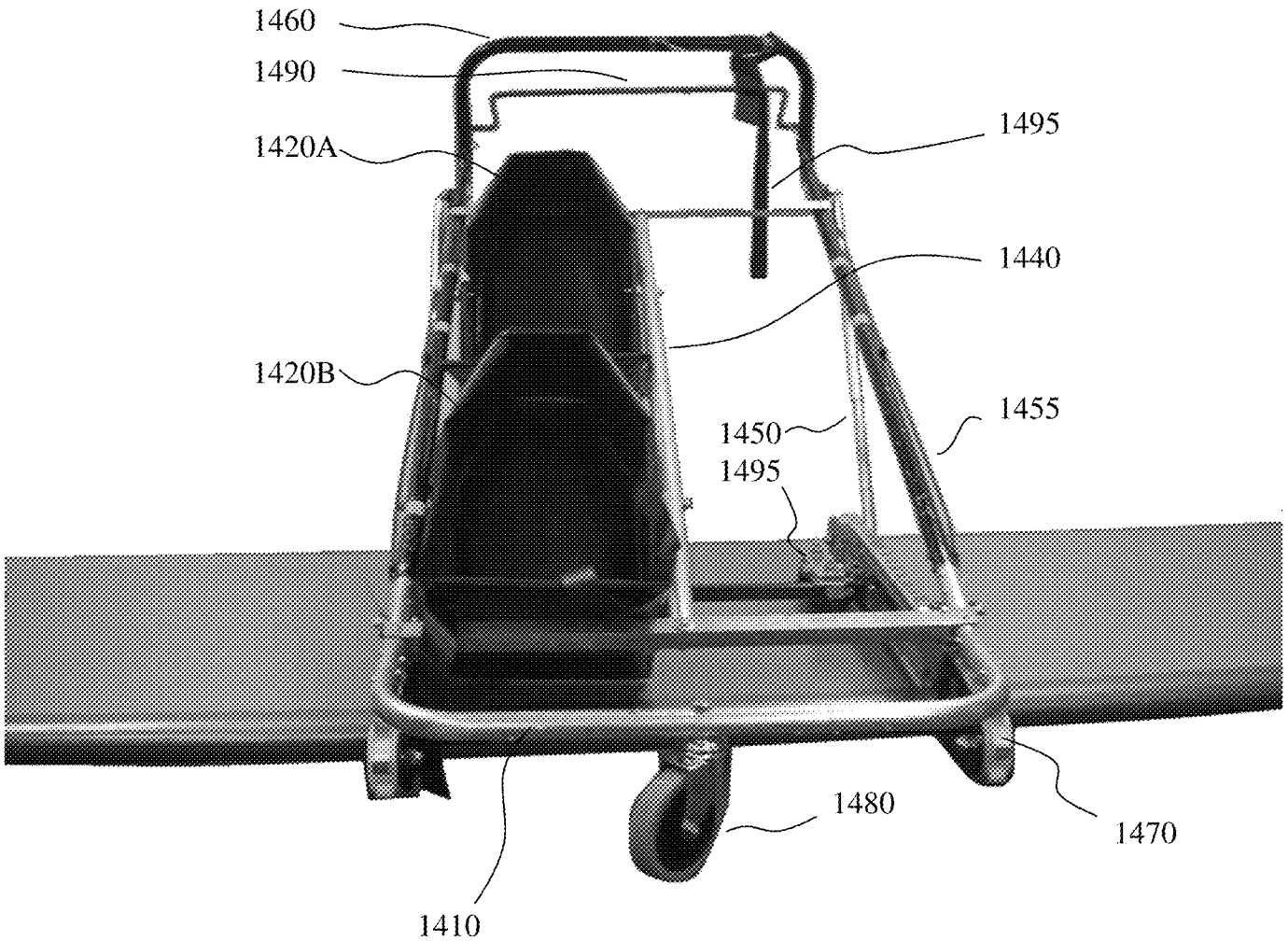
FIG. 14 depicts a front view of an evacuation device according to an embodiment of the invention upon a horizontal surface.
Figure 15:
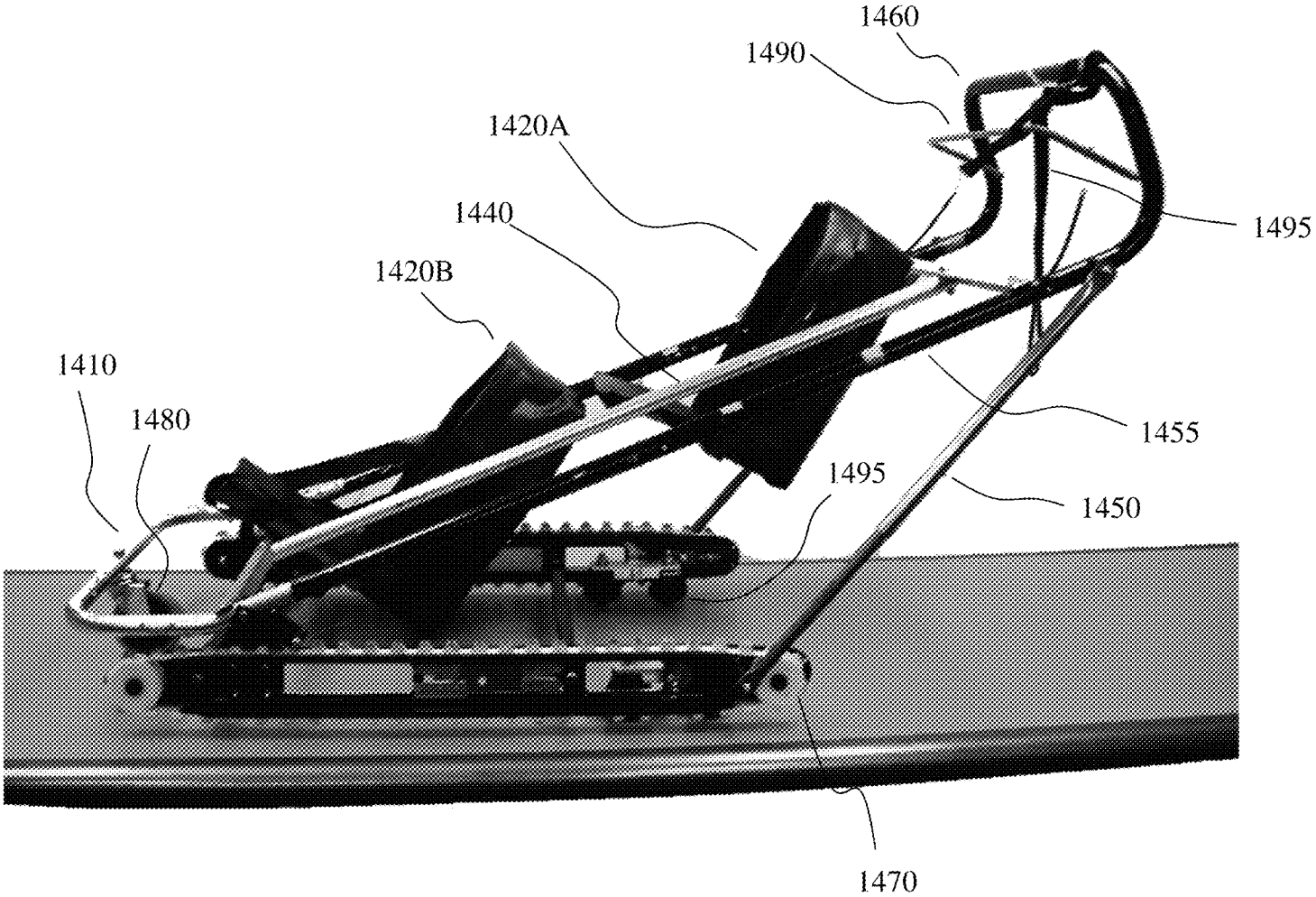
FIG. 15 depicts a side view of an evacuation device according to an embodiment of the invention upon a horizontal surface.
Figure 16:
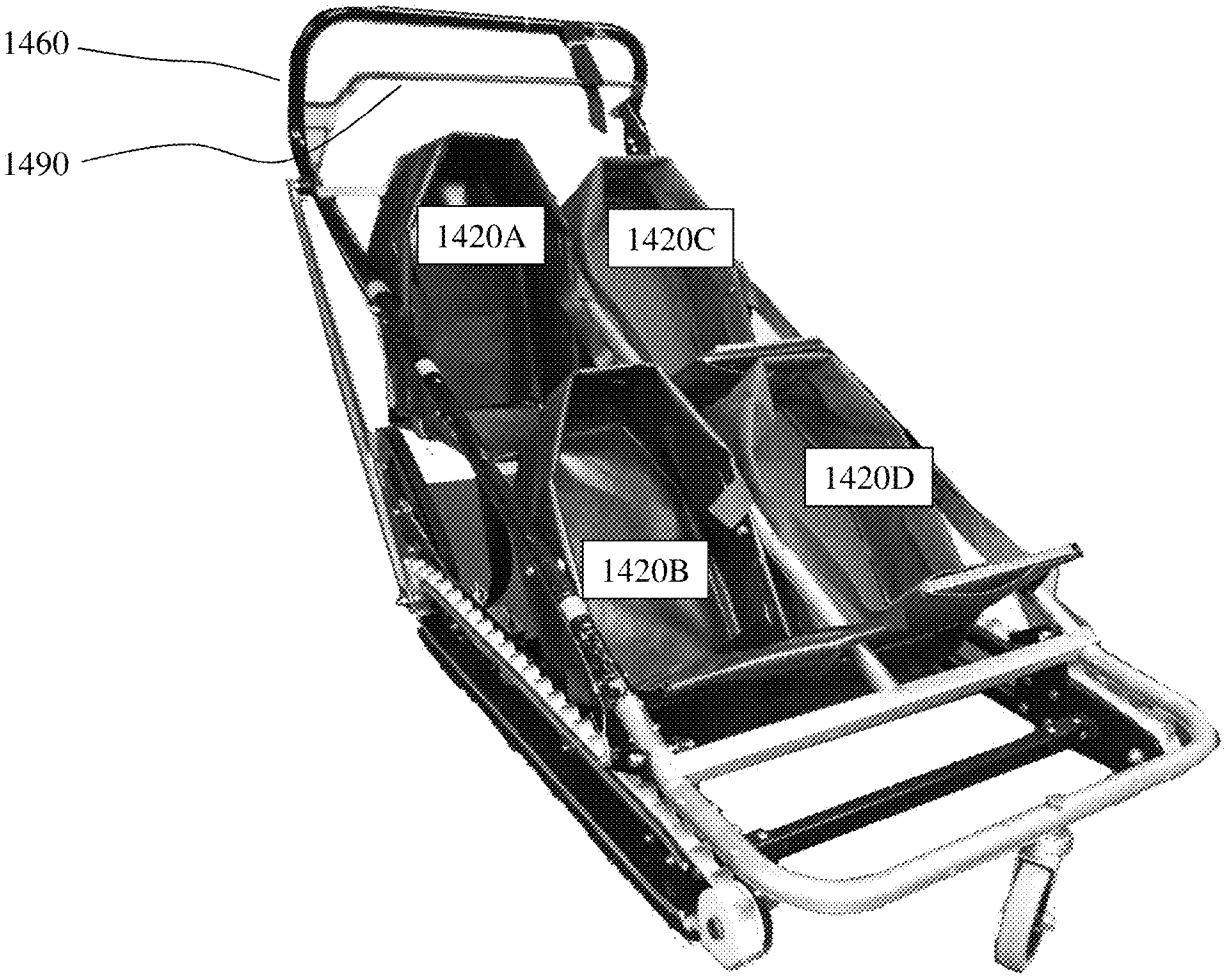
FIG. 16 depicts a front view of an evacuation device according to an embodiment of the invention upon a horizontal surface.

In contrast the second handle assembly comprises a handle 1110 and a brake handle 1120. The brake handle 1120 is connected to one or more brake cables 1130 to engage the brake or brakes upon the evacuation device according to an embodiment of the invention. The handle 1110 projects substantially upwards, such as depicted with handle 1460 of the I-EVAC depicted in FIG. 14, such that the individual controlling the evacuation device according to an embodiment of the invention can push the handle 1110 when the evacuation device according to an embodiment of the invention is both on the horizontal or going down a flight of stairs wherein the handle is approximately horizontal in this latter scenario. However, whilst an R-EVAC such as depicted within FIGS. 12 and 13 will have, at full load three babies and/or infants the I-EVAC such as depicted in FIGS. 14 to 16 respectively will have, at full load, four toddlers and/or infants. Accordingly, the I-EVAC will be substantially heavier under most use scenarios relative to the R-EVAC. Considering that the typical user within hospital environments will be a nurse, often female, then the substantially upward facing handle on the I-EVAC means that the user if seeking to lift the rear of the I-EVAC is now pushing upwards with their arms rather than seeking to lift the handle and similarly when going down the flight of stairs their arms will be in a more beneficial position.

Respirator Evacuation Device (R-EVAC)

Figure 12:
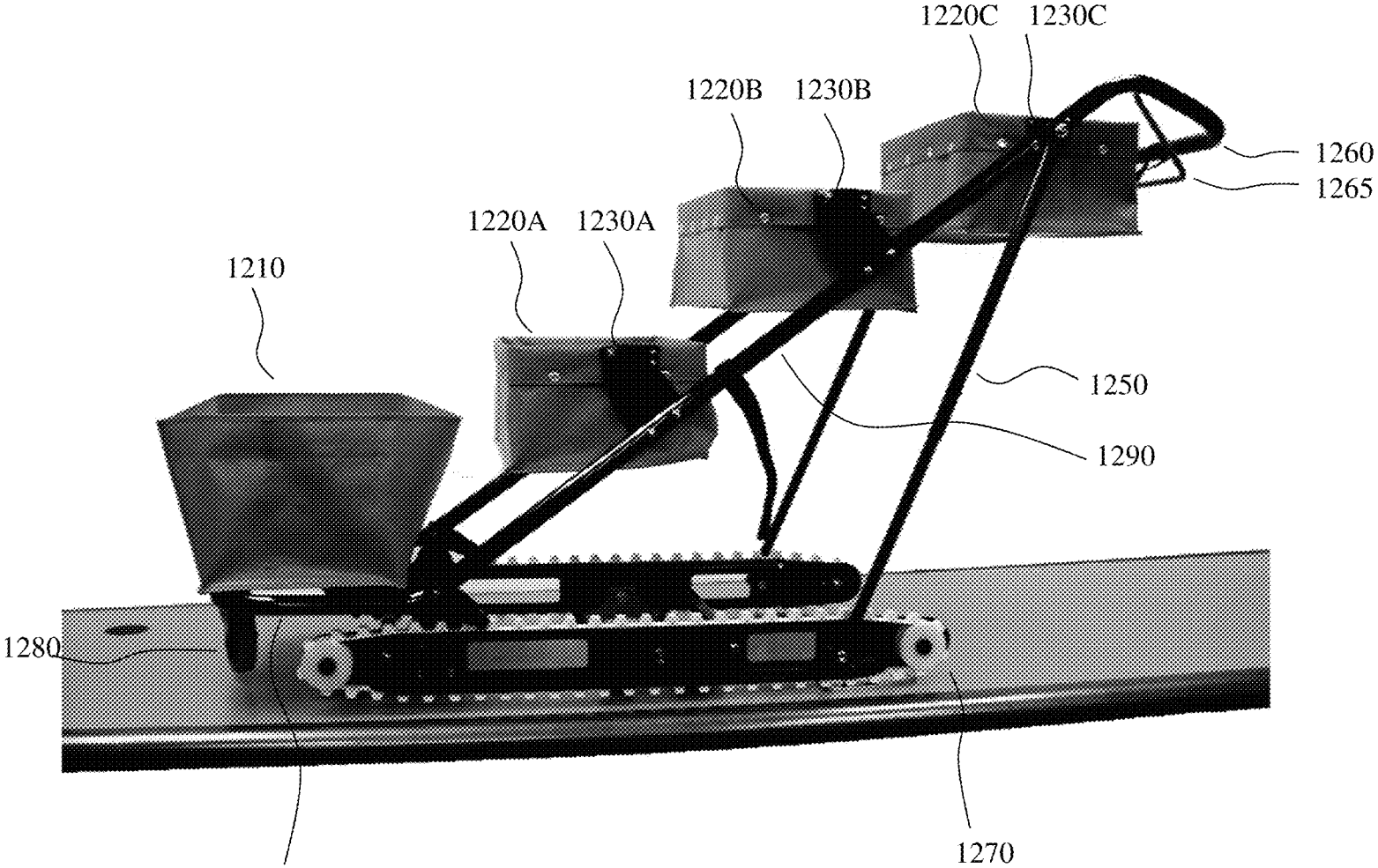
FIG. 12 depicts a side view of an evacuation device according to an embodiment of the invention upon a horizontal surface.
Figure 13:
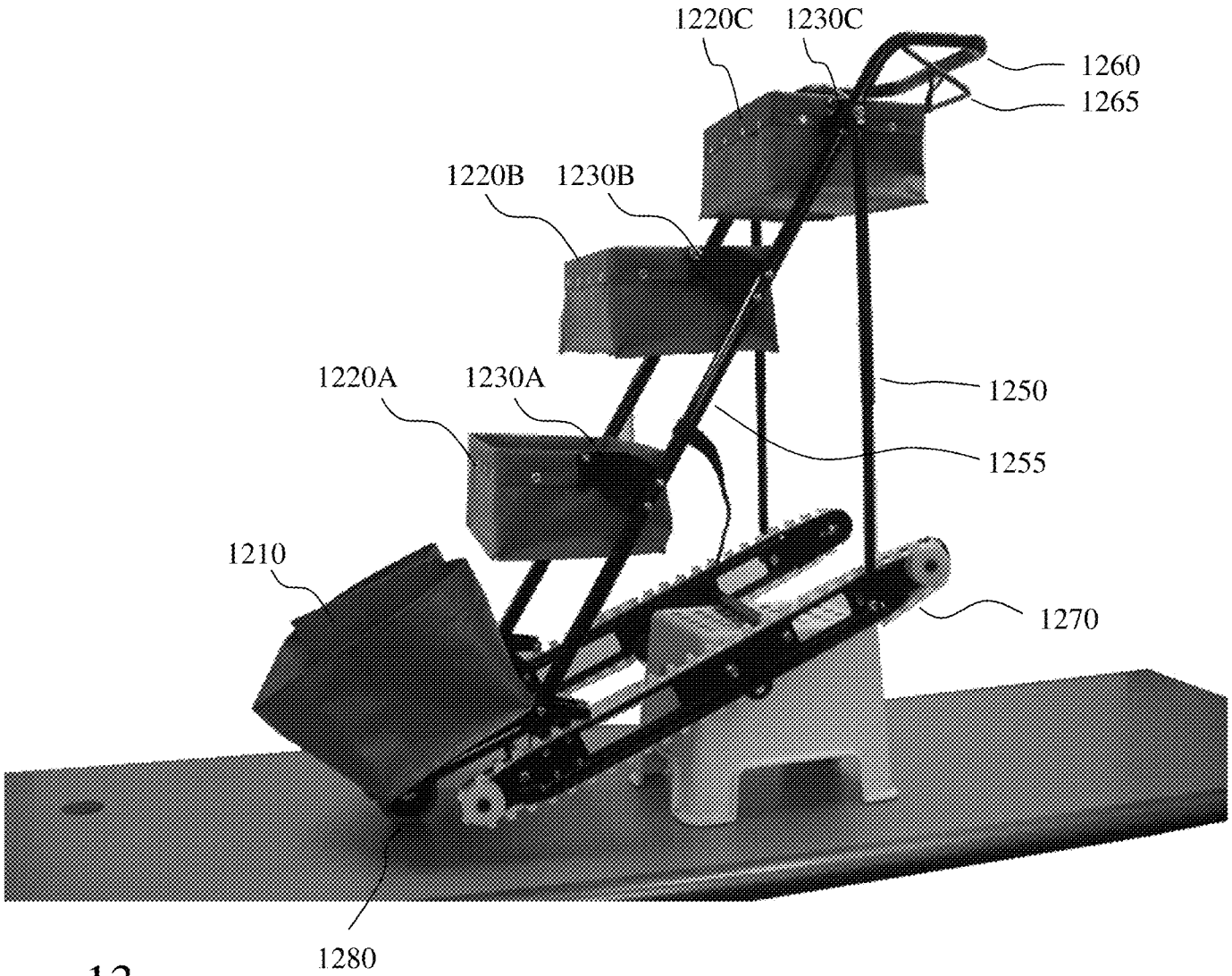
FIG. 13 depicts a side view an evacuation device according to an embodiment of the invention upon a simulated incline as would be experienced with stairs.

FIGS. 12 and 13 depict side views of an R-EVAC evacuation device according to an embodiment of the invention upon a horizontal surface and a simulated incline respectively. Accordingly, the caster 1280, track assemblies 1270 and main frame 1240 are depicted together with the upper frame 1290 and the strut 1250. Disposed upon the main frame 1240 at the front is carrier 1210 allowing one or battery powered pumps and associated one or more drip bags etc. to be placed onto the R-EVAC. Optionally, the carrier 1210 may carry a pump for one or more self-inflating BVMs employed in conjunction with one or more babies disposed with the first to third cots 1220A to 1220C which are disposed along and between the pair of upper frames 1210. Optionally the caster 1280 may be a pair of casters 1280, or more, according to the design and/or customer requirements. Within embodiments of the invention the one or more casters 1280 at the front are positioned such that they do not touch the ground when the R-EVAC is on the horizontal such that the track assemblies 1270 are in contact with the ground and hence provides a resistance to motion such that the R-EVAC does not move, even if the brake 1265 is not applied or becomes stuck open, for example when implemented in a "dead-man's handle" configuration such that absent pressure to pull the brake 1265 towards the handle 1260 the brake is applied.

Each of the first to third cots 1220A to 1220C is attached at either end to the upper frames 1210 by first to third mountings 1230A to 1230C respectively. Each mounting comprising a pivotable connection to the associated cot and an adapter plate to the upper frame. Accordingly, as evident from FIGS. 12 and 13 as the I-EVAC is transitioned from horizontal use to going down stairs the first to third cots 1220A to 1220C remain horizontal. Optionally, the carrier 1210 may also be mounted in a similar manner such that it remains in a horizontal orientation as the R-EVAC moves from horizontal to tilted for stairs and back to horizontal. Each of the first to third mountings 1230A to 1230C also includes mechanical stops comprising a first part on the cot (first to third cots 1220A to 1220C) and a second part on the mounting so that the range of tilt of the cot (first to third cots 1220A to 1220C) relative to the upper frame 1290 is limited in each direction. Optionally, these mechanical stops may include impact absorbent materials such as foam or rubber for example to reduce the mechanical impact to the cot and the baby within.

It is also evident from FIG. 13 that the handle 1260 of the R-EVAC is angled such that it is horizontal for the operator as they are traversing the stairs. The brake 1265 is also evident to lock the track assemblies 1270 either when on the horizontal, such as when placing infants or babies into the cots, or when going down a flight of stairs. The width of the R-EVAC is narrower than the BED or I-EVAC within embodiments of the invention as it allows a second operator to be adjacent to the R-EVAC in use across the floor and down the flight or flights of stairs so that the second operator can monitor the babies within the cots and/or provide assisted breathing with a BVM.

Infant Evacuation System (I-EVAC)

FIGS. 14 to 16 depict front and side views of a partially assembled I-EVAC evacuation device according to an embodiment of the invention upon a horizontal surface and a simulated incline respectively. Accordingly, the caster 1480, track assemblies 1470, gliding assemblies 1495 and main frame 1410 are depicted together with the upper frame 1455, strut 1450, brake 1490 and handle 1460. In addition, a second frame is disposed between the pair of upper frames 1455 such that a central bar 1440 is disposed parallel to each of the upper frames 1455. Mounted between each upper frame 1455 and the central bar 1440 are a pair of seats 1420A and 1420B for an infant and/or toddler. Each of the pair of seats 1420A and 1420B are mounted via mountings, not identified. Each mounting comprising a pivotable connection to the associated cot and an adapter plate to the upper frame. Accordingly, as the I-EVAC is transitioned from horizontal use to going down stairs the pair of seats 1420A and 1420B remain relatively stable relative to the horizontal plane. Optionally the caster 1480 may be a pair of casters 1480, or more, according to the design and/or customer requirements.

Within embodiments of the invention with the I-EVAC, in contrast to the R-EVAC the one of more casters 1480 and gliding assemblies 1495 project down below the level of the track assemblies 1470 such that the I-EVAC when on horizontal ground acts as a stroller which can be moved around with ease on the horizontal ground. This being beneficial due to the increased weight for the operator of moving up to four infants/toddlers versus up to three babies with the R-EVAC. However, to prevent movement of the I-EVAC in some embodiments of the invention without an operator the brake 1490 is implemented in a "dead-man's handle" configuration such that absent pressure to pull the brake 1490 towards the handle 1460 the brake 1490 is automatically applied. Additionally, to further limit movement of the R-EVAC if the brake 1490 fails under any circumstances the R-EVAC includes a tether 1495 which is attached to the handle 1460 at one end and is designed, at the other free end, to be placed around the operator's wrist or forearm. Accordingly, if the operator falls, for example, and the brake 1490 fails then the R-EVAC is limited to move away from the operator by the length of the tether 1495. Optionally, to avoid injury to the operator with such a load suddenly being applied to their wrist or forearm the tether 1495 may also be designed to comprise a tether comprising a first portion designed to fit around the operator's waist and a second portion linking the first portion to the R-EVAC. Optionally, a simple second tether around the user waist that simply runs around from one side of the R-EVAC to the other around the operators back may also be applied in conjunction with a tether 1495.

FIGS. 14 and 15 depict the I-EVAC with only one side filled with a pair of seats 1420A and 1420B. Within FIG. 16 the I-EVAC is depicted with four seats 1420A to 1420D respectively. Within these Figured 14 to 16 respectively the seats are depicted as front facing. However, within other embodiments of the invention the seats may be rear facing or alternatively the front pair may be front facing and the rear pair rear facing to avoid any issues with those in the rear kicking the seats in front.

Optionally, the carrier may also be mounted in a similar manner at the front to the main frame 1410 such that it remains in a horizontal orientation as the I-EVAC moves from horizontal to tilted for stairs and back to horizontal. Each of the mountings also includes mechanical stops comprising a first part on the seat (on of pair of seats 1420A and 1420B) and a second part on the mounting so that the range of tilt of the seat (one of pair of seats 1420A and 1420B) relative to the upper frame 1455 is limited in each direction. Optionally, these mechanical stops may include impact absorbent materials such as foam or rubber for example to reduce the mechanical impact to the seat and the infant and/or toddler within.

Not depicted within FIGS. 14 to 16 are an optional carrier which can be mounted to the main frame 1410 allowing one or battery powered pumps and associated one or more drip bags etc. to be placed onto the I-EVAC. Optionally, the carrier 1210 may carry a pump for one or more self-inflating BVMs employed in conjunction with one or more toddlers and/or infants disposed with the seats. Also not depicted with respect to each seat are an optional headrest and a seat belt to keep the toddler and/or infant restrained within the seat. This seat belt may be a simple across the chest seat belt such as used in vehicles etc. or it may be a multi-point harness such as employed within child car seats, children's carriers, prams, etc.

Materials and Options

Optionally, the cots, such as first to third cots 1220A to 1220C, and seats such as pair of seats 1420A and 1420B may be formed from a flame-retardant material, a mildew resistant material, or a material that is both flame-retardant and mildew resistant.

Optionally, the cots, such as first to third cots 1220A to 1220C, and/or seats such as pair of seats 1420A and 1420B may be formed with an opening, either permanently open or covered with a removable stopper or plug, to allow washing and draining of the inner surfaces of the cots and/or seats.

Optionally, the cots, such as first to third cots 1220A to 1220C, and seats such as pair of seats 1420A and 1420B may be provided with covers that can be employed to cover the cots and/or seats once the baby, infant, or toddler as appropriate has been placed within. These covers may within embodiments of the invention be removable allowing attachment, detachment and storage with the I-EVAC. Optional, these covers may within embodiments of the invention be pivotably attached to the cots such that they are always present. These covers may be maintained in position covering the cot when the cot is detached from the R-EVAC outside the emergency zone or they may be placed into position covering the occupant of the cot prior to the cot's attachment to the R-EVAC.

Optionally, in instances that a BVM or self-inflating BVM is employed then the cover may provide an elasticated or otherwise openable/closable/sealable opening to fit around a predetermined portion of the BVM or self-inflating BVM such as between the mask and the end of the bag. Optionally, the cover may be hard cover with the BVM or self-inflating BVM integrated as part of the cover with a flexible mounting between the BVM or self-inflating BVM integrated within the cover to the occupant.

Optionally, the cots, such as first to third cots 1220A to 1220C, and seats such as pair of seats 1420A and 1420B may be removable from their respective I-EVAC and R-EVAC respectively. In this instance the cots and/or seats may have a first part of a demountable connection or fitting that interfaces with a second part of the demountable connection or fitting forming part of the mountings to the upper frames. These fittings may allow the cot and/or seat to be "snapped" into position and the fittings self-closing for ease and speed of use in a stressful emergency situation. Subsequently, once the emergency is over or the I-EVAC and/or R-EVAC is away from immediate danger and the removal of the cots and/or seats can be performed by opening the fittings again to release the cots and/or beds.

Within the embodiments of the invention for the I-EVAC the seats are depicted as facing away from the operator. However, within other embodiments of the invention they may be facing the operator or those on one side may be facing the operator and another side facing away or other combinations. Alternatively, the seats may be facing towards each other side to side or front to back.

Within the embodiments of the invention described and depicted the handle and brake have been described and depicted as being disposed between the left and right hand upper frame elements. However, it would be evident that these could be replaced with a handle on each of the left and right hand upper frame elements with no connection between wherein the brake may be disposed in proximity to either one or both of the left or right hand handles.

The foregoing disclosure of the exemplary embodiments of the present invention has been presented for purposes of illustration and description. It is not intended to be exhaustive or to limit the invention to the precise forms disclosed. Many variations and modifications of the embodiments described herein will be apparent to one of ordinary skill in the art in light of the above disclosure. The scope of the invention is to be defined only by the claims appended hereto, and by their equivalents.

Further, in describing representative embodiments of the present invention, the specification may have presented the method and/or process of the present invention as a particular sequence of steps. However, to the extent that the method or process does not rely on the particular order of steps set forth herein, the method or process should not be limited to the particular sequence of steps described. As one of ordinary skill in the art would appreciate, other sequences of steps may be possible. Therefore, the particular order of the steps set forth in the specification should not be construed as limitations on the claims. In addition, the claims directed to the method and/or process of the present invention should not be limited to the performance of their steps in the order written, and one skilled in the art can readily appreciate that the sequences may be varied and still remain within the spirit and scope of the present invention.

What is claimed is:

1. An evacuation device for a plurality of babies comprising:

a lower frame providing means for moving the evacuation device both across a horizontal floor and down a flight of stairs;

an upper frame connected to the lower frame comprising a first frame disposed on a first side of the evacuation device along a first predetermined portion of the length of the evacuation device and a second frame disposed on a second distal side of the evacuation device and along a second predetermined portion of the length of the evacuation device; and a plurality of cots disposed between the first frame and the second frame and pivotably mounted to each of the first frame and the second frame; wherein the plurality of cots maintain an approximately constant orientation relative to a horizontal plane upon motion of the evacuation device both across the horizontal floor and down the flight of stairs.

2. The evacuation device according to claim 1, wherein a portion of the plurality of cots are demountably attached to the first frame and the second frame.

3. The evacuation device according to claim 1, wherein at least one of the pivotable mounts of each cot within a portion of the plurality of cots comprises a first stop for limiting motion of the cot relative to the horizontal plane upon motion of the evacuation device either across the horizontal floor or down the flight of stairs.

4. The evacuation device according to claim 1, wherein at least one of the pivotable mounts of each cot within a portion of the plurality of cots comprises:

a first stop for limiting motion of the cot in a first direction relative to the horizontal plane upon motion of the evacuation device either across the horizontal floor or down the flight of stairs; and a second stop for limiting motion of the cot in a second direction relative to the horizontal plane upon motion of the evacuation device either across the horizontal floor or down the flight of stairs.

5. The evacuation device according to claim 1, wherein the width of the evacuation device allows a first operator to move the device and a second operator to be beside the device within at least a stairwell to access the occupants of the cots during movement of the evacuation device within the at least a stairwell.

6. The evacuation device according to claim 1, further comprising a brake handle connected to a brake arm; and a pair of track assemblies each comprising a continuous track having a plurality of grooves around its exterior to engage surfaces the evacuation device is traversed across and having a length greater than at least the distance between a pair of step nosings on the standard flight of stairs; wherein each track assembly of the pair of track assemblies is mounted on one side of the evacuation device; and the brake arm engages one or more grooves within the plurality of grooves when the brake is not operated.

7. An evacuation device for a plurality of babies comprising:

a lower frame providing means for moving the evacuation device both across a horizontal floor and down a flight of stairs;

an upper frame connected to the lower frame comprising a first frame disposed towards a first side of the evacuation device along a first predetermined portion of the length of the evacuation device and a second frame disposed towards a second distal side of the evacuation device and along a second predetermined portion of the length of the evacuation device; and a plurality of seats disposed between the first frame and the second frame and pivotably mounted to each of the first frame and the second frame; wherein the plurality of seats maintain an approximately constant orientation relative to a horizontal plane upon motion of the evacuation device both across the horizontal floor and down the flight of stairs.

8. The evacuation device according to claim 7, wherein a portion of the plurality of seats are demountably attached to the first frame and the second frame.

9. The evacuation device according to claim 7, wherein at least one of the pivotable mounts of each cot within a portion of the plurality of seats comprises a first stop for limiting motion of the cot relative to the horizontal plane upon motion of the evacuation device either across the horizontal floor or down the flight of stairs.

10. The evacuation device according to claim 7, wherein at least one of the pivotable mounts of each cot within a portion of the plurality of seats comprises:

a first stop for limiting motion of the cot in a first direction relative to the horizontal plane upon motion of the evacuation device either across the horizontal floor or down the flight of stairs; and a second stop for limiting motion of the cot in a second direction relative to the horizontal plane upon motion of the evacuation device either across the horizontal floor or down the flight of stairs.

11. The evacuation device according to claim 7, further comprising a third frame disposed further towards the first side of the evacuation device than the first frame and along a first predetermined portion of the length of the evacuation device; and a plurality of second seats disposed between the first frame and the third frame and pivotably mounted to each of the first frame and the third frame; wherein the plurality of seats maintain an approximately constant orientation relative to a horizontal plane upon motion of the evacuation device both across the horizontal floor and down the flight of stairs.

12. The evacuation device according to claim 7, wherein a first portion of the plurality of seats are facing in a first direction relative to an operator of the device; and a second portion of the plurality of seats are facing in a second direction relative to the operator of the device.

13. The evacuation device according to claim 7, further comprising a brake handle connected to a brake arm; and a pair of track assemblies each comprising a continuous track having a plurality of grooves around its exterior to engage surfaces the evacuation device is traversed across and having a length greater than at least the distance between a pair of step nosings on the standard flight of stairs; wherein each track assembly of the pair of track assemblies is mounted on one side of the evacuation device; and the brake arm engages one or more grooves within the plurality of grooves when the brake is not operated.

* * * * *